US007556569B1

(12) United States Patent
Caserta

(10) Patent No.: US 7,556,569 B1
(45) **Date of Patent: *Jul. 7, 2009**

(54) DETACHABLE GUIDE ASSEMBLY FOR A GOLF PUTTER AND ITS ASSOCIATED METHOD OF USE

(76) Inventor: Richard M. Caserta, 11 N. 2nd St., Apt. 503, Philadelphia, PA (US) 19106

( * ) Notice: Subject to any disclaimer, the term of this patent is extended or adjusted under 35 U.S.C. 154(b) by 346 days.

This patent is subject to a terminal disclaimer.

(21) Appl. No.: 11/438,985

(22) Filed: May 24, 2006

Related U.S. Application Data

(63) Continuation-in-part of application No. 11/027,597, filed on Jan. 3, 2005, now Pat. No. 7,104,899, which is a continuation-in-part of application No. 10/828,618, filed on Apr. 22, 2004, now Pat. No. 7,104,898.

(51) Int. Cl.
*A63B 69/36* (2006.01)

(52) U.S. Cl. ..... 473/236; 473/238; 473/251

(58) Field of Classification Search ..... 473/219–256, 473/257–260
See application file for complete search history.

(56) References Cited

U.S. PATENT DOCUMENTS 3,262,705 A * 7/1966 Nunziato ..... 473/238
3,667,761 A 6/1972 Palotsee ..... 273/186
5,351,961 A * 10/1994 Eulau ..... 473/252
5,441,270 A * 8/1995 Williams ..... 473/251
5,447,313 A 9/1995 Finley ..... 273/187.4
5,499,817 A * 3/1996 Brady ..... 473/409
5,551,695 A 9/1996 Wolk ..... 473/236
6,849,001 B2 * 2/2005 Simpson ..... 473/226
6,872,149 B1 * 3/2005 Devon ..... 473/231
7,104,898 B1 * 9/2006 Caserta ..... 473/236
7,104,899 B1 * 9/2006 Caserta ..... 473/236
7,396,288 B2 * 7/2008 McLauhglin ..... 473/236

* cited by examiner

*Primary Examiner*—Sebastiano Passaniti
(74) *Attorney, Agent, or Firm*—LaMorte & Associates

(57) ABSTRACT

A putting guide assembly and its associated method of use. The putting guide assembly attaches to the head of a putter. The putter head has a striking surface for striking a golf ball. The putting guide assembly is attached to the putter and presents a rod that extends forward of the putter's striking surface. The rod has a first end, a second end and at least one curved section in between those two ends. The rod can be rotated into different orientations while being attached to the putter. As the rod is rotated, the perceived curvature of the rod that is observed by a golfer holding the putter changes. A golfer can therefore selectively change the perceived curvature of the rod to match the natural curvature inherent in that golfer's putting swing.

16 Claims, 6 Drawing Sheets

DETACHABLE GUIDE ASSEMBLY FOR A GOLF PUTTER AND ITS ASSOCIATED METHOD OF USE

RELATED APPLICATIONS

This application is a continuation-in-part of application Ser. No. 11/027,597 filed Jan. 3, 2005, now U.S. Pat. No. 7,104,899 entitled Golf Putter With Extending Training Rail Device And Its Associated Method Of Use, which is a continuation-in-part of application Ser. No. 10/828,618, filed Apr. 22, 2004, now U.S. Pat. No. 7,104,898 entitled Golf Putter Training Device And Method.

BACKGROUND OF THE INVENTION

1. Field of the Invention

In general, the present invention relates to the structure of putters that are used in playing the game of golf. More particularly, the present invention is directed toward golf putters with secondary visual and/or tactile aids that can be used in developing a proper putting swing.

2. Description of Related Art

In the game of golf, the object of the game is to get a golf ball into a distant golf hole with as few strokes of a golf club as possible. In golf, the hole is positioned on a green of finely manicured grass. When a golf ball lands on the green, it is most commonly struck toward the hole with a putter. A putter is a golf club that has a generally flat striking surface. Thus, when a golf ball is struck with the putter, the golf ball tends to roll forward on the green rather than fly up into the air.

The prior art is replete with many different designs for putters and putter heads. In this collection of designs, there exist many golf putters that have features that are intended to help a golfer practice proper putting techniques.

When a golfer putts, the golfer wants to strike the golf ball flush in the center of the putter, without having the putter experience any lateral movement relative the ball. That is, the head of the putter should only be traveling in the exact direction the golfer wants the golf ball to travel when the putter strikes the golf ball. In order to consistently putt in this manner, a golfer must practice his putting and his golf swing with the putter.

In the prior art, golf putters have been created that contain guide rods. The guide rods extend from the golf putter and provide a visual and/or tactile reference guide that can be used to practice putting. For example, in U.S. Pat. No. 5,447,313, to Finley, entitled Golf Putter With Foldable Aiming Device, a putter is shown having a rod that extends behind the face of the putter at a perpendicular. The rod provides a visual alignment tool to a golfer practicing putting. By aligning the rod with the golf ball and keeping the rod in alignment with the golf ball throughout the putter's swing, a person can train himself/herself to properly swing the putter.

In U.S. Pat. No. 3,667,761, to Palotsee, entitled Golf Putter With Aligning Device, another putter is shown that uses a rod as a visual aid. In this patent, the rod extends out in front of the putter's face and passes over the top of a golf ball as the putter strikes the golf ball. Again, the rod provides a visual alignment tool to a person practicing putting. By aligning the rod with the golf ball and keeping the rod in alignment with the golf ball throughout the putter's swing, a golfer can train himself/herself to properly swing the putter.

In U.S. Pat. No. 5,551,695, to Wolk, entitled Apparatus For Training A Golfer To Properly Putt A Golf Ball, yet another putter design is shown that uses rods. In the Wolk design, two parallel rods extend from the front of the putter's face. The rods provide both a visual indicator and a tactile indicator for a golfer. If a golfer swings straight, the rods travel straight and the golf ball strikes the putter's face without touching the rods. If a golf swing is not straight, the rods will not travel straight and the rods will strike the golf ball.

A problem associated with prior art putters that use guide rods is that the guide rods are usually very short and straight. The guide rods are therefore only useful when the face of the golf club is very close to the golf ball. However, in reality, most golfers have a putting swing where the head of the putter travels more than a foot before it contacts the golf ball. Prior art guide rods are only a few inches long. Thus, short guide rods are not useful guides throughout most of the putting swing. Furthermore, many golfers have a putting swing that curves slightly as they rotate. Thus, the head of the putter moves along a slightly curved path as the putter head travels toward the golf ball. In the prior art, guide rods are straight. Prior art guide rods therefore do not accurately align with the path of travel of the putter and can therefore cause a golfer to misalign a putt.

A need therefore exists for a golf putter that provides a long, curved guide rod that acts as an accurate visual and tactile reference throughout an entire putting swing. This need is met by the present invention as it is described and claimed below.

SUMMARY OF THE INVENTION

The present invention is a putting guide assembly and its associated method of use. The putting guide assembly attaches to the head of a putter. The putter head has a striking surface for striking a golf ball. The putting guide assembly is attached to the putter and presents a rod that extends forward of the putter's striking surface. The rod has a first end, a second end and at least one curved section in between those two ends.

The rod can be rotated into different orientations while being attached to the putter. As the rod is rotated, the perceived curvature of the rod that is observed by a golfer holding the putter changes. A golfer can therefore selectively change the perceived curvature of the rod to match the natural curvature inherent in that golfer's putting swing. The rod therefore presents a visual and tactile guide to the golfer that helps the golfer create straight putts, even if the golfer's putting motion produces a slighted curved movement in the travel path of the putter.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

In the field of golf putters, there are many different designs and styles. The illustrated embodiments of the present invention show only two traditional putter designs. It will be understood that the embodiments of the putter illustrated are merely exemplary and that the features of the present invention can be adapted for use on most any known putter design.

Figure 1:
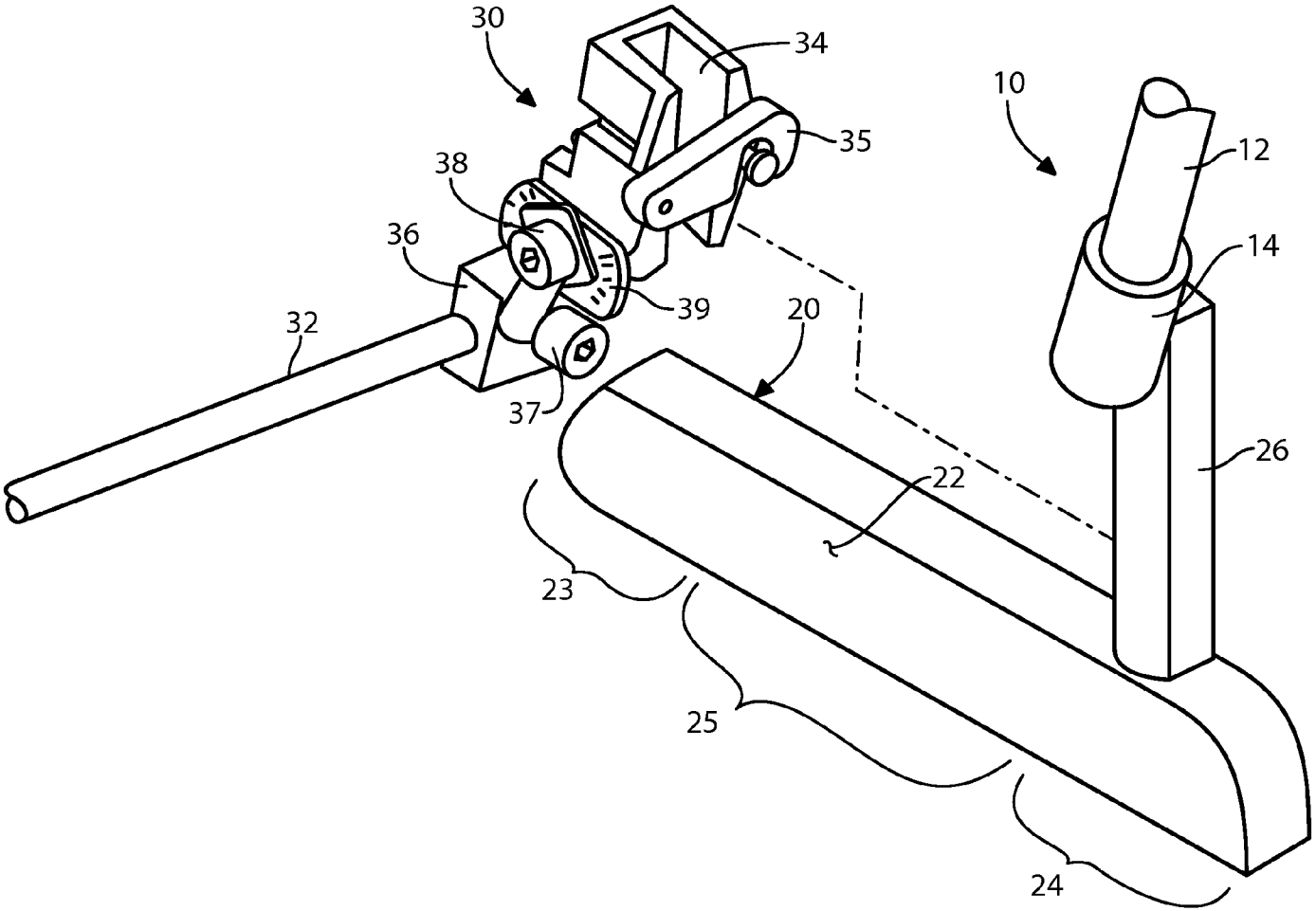
FIG. 1 is a perspective view of an exemplary embodiment of the present invention shown in an exploded fashion with a putter head.
Figure 2:
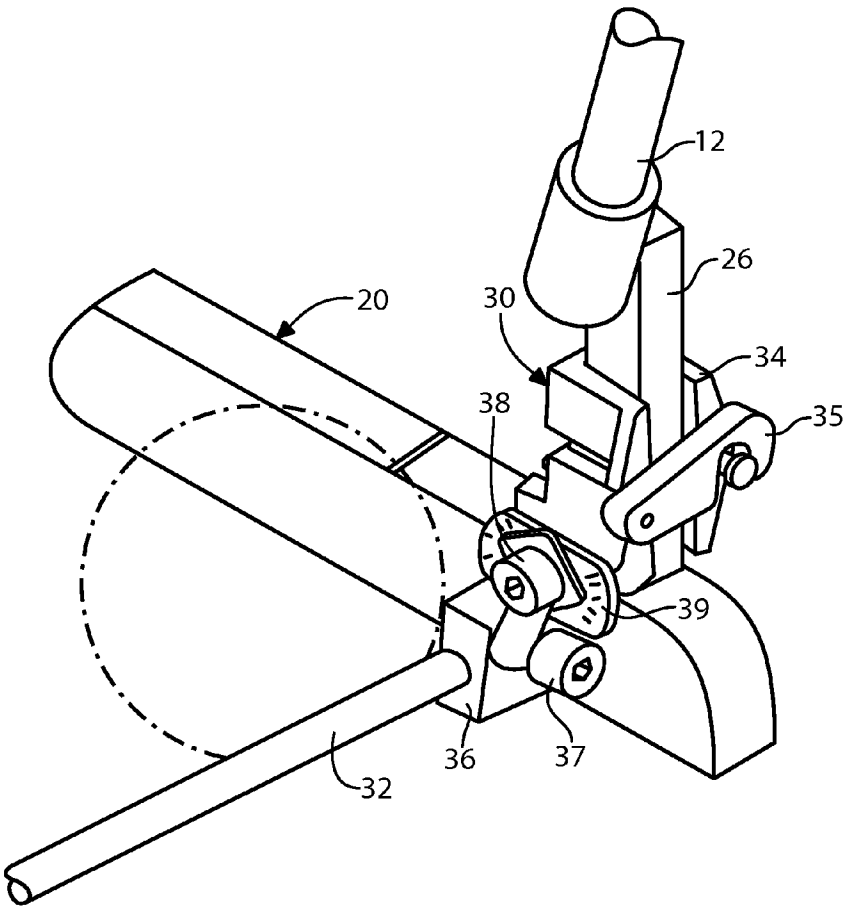
FIG. 2 is an assembled view of the components of FIG. 1.

Referring to FIG. 1 and FIG. 2, there is shown a putter 10. The putter 10 has a shaft 12 with a bottom end 14. The top end of the shaft 12 terminates with a grip handle in a traditional manner. A putter head 20 is disposed at the bottom end 14 of the shaft 12. The putter head 20 has a generally flat striking surface 22 that is used to strike a golf ball when putting.

A putting guide assembly 30 is provided. The putting guide assembly 30 attaches to the putter 10. The putting guide assembly 30 contains a training rod 32. When attached to the putter 10, the putting guide assembly 30 retains the training rod 32 in a position generally perpendicular to the flat striking surface 22 of the putter head 20.

The putter head 20 has a toe section 23, a heel section 24 and a central section 25 disposed in between the toe section 23 and the heel section 24. Ideally, a golfer wants to strike a golf ball with the central section 25 of the striking surface 22. It is also desired that the plane of the striking surface 22 be perfectly perpendicular to the desired line of travel for the golf ball at the moment of golf ball impact.

The shown embodiment of a putter 10 also shows a vertical leg 26 that extends upwardly from the putter head 20. The vertical leg 26 attaches the putter head 20 to the shaft 12 of the putter 10.

The putting guide assembly 30 contains a mounting clamp 34. The mounting clamp 34 is shaped and sized to engage the vertical leg 26 of the putter head 20. The mounting clamp 34 has a lever arm 35 that enables the mounting clamp 34 to be selectively opened and closed. Accordingly, it will be understood that the mounting clamp 34 of the putting guide assembly 30 can be selectively detached from the putter 10.

The mounting clamp 34 is attached to a rod anchor block 36. The rod anchor block 36 engages one end of the training rod 32 and holds the training rod 32 in a horizontal orientation as a cantilever. A set screw retains the end of the training rod 32 within the rod anchor block 36. The orientation of the rod anchor block 36, and thus the training rod 32, can be selectively changed. The rod anchor block 36 is attached to the mounting clamp 34 with a single pivot screw 38. When the pivot screw 38 is loose, the rod anchor block 36 and the training rod 32 can be rotated relative to the mounting clamp 34. Once the pivot screw 38 is tightened, the rod anchor block 36 and training rod 32 become fixed in a single plane relative the mounting clamp 34. The pivot screw 38 is set in a gauge 39. The gauge 39 is affixed to the rod anchor block 36. Accordingly, by viewing the gauge 39, a person can visually ascertain the angle of the rod anchor block 36 relative to the mounting clamp 34.

A second pivot screw 37 is also used to adjust the relative position of the anchor block 36 relative to the remainder of the putter guide assembly 30. When the second pivot screw 37 is loosened, the anchor block 36 can be turned up and down. This movement causes the training rod 32 to move up and down in the directions of arrows 43, 45. Many golfers do not have a perfectly level putting swing. Rather, many golfers have a pendulum swing where that causes the putter head 20 to be at different heights above the ground at different points during the swing. By enabling the training rod 32 to be adjusted either up or down, the training rod 32 can be made to compensate for different swing stiles.

When attached to the putter head 20, the putting guide assembly 30 supports the training rod 32 in front of the heel section 24 of the striking surface 22. However, it should be understood that in an alternate embodiment, the rod can be supported in front of the toe section 23 of the striking surface 22.

Figure 3:
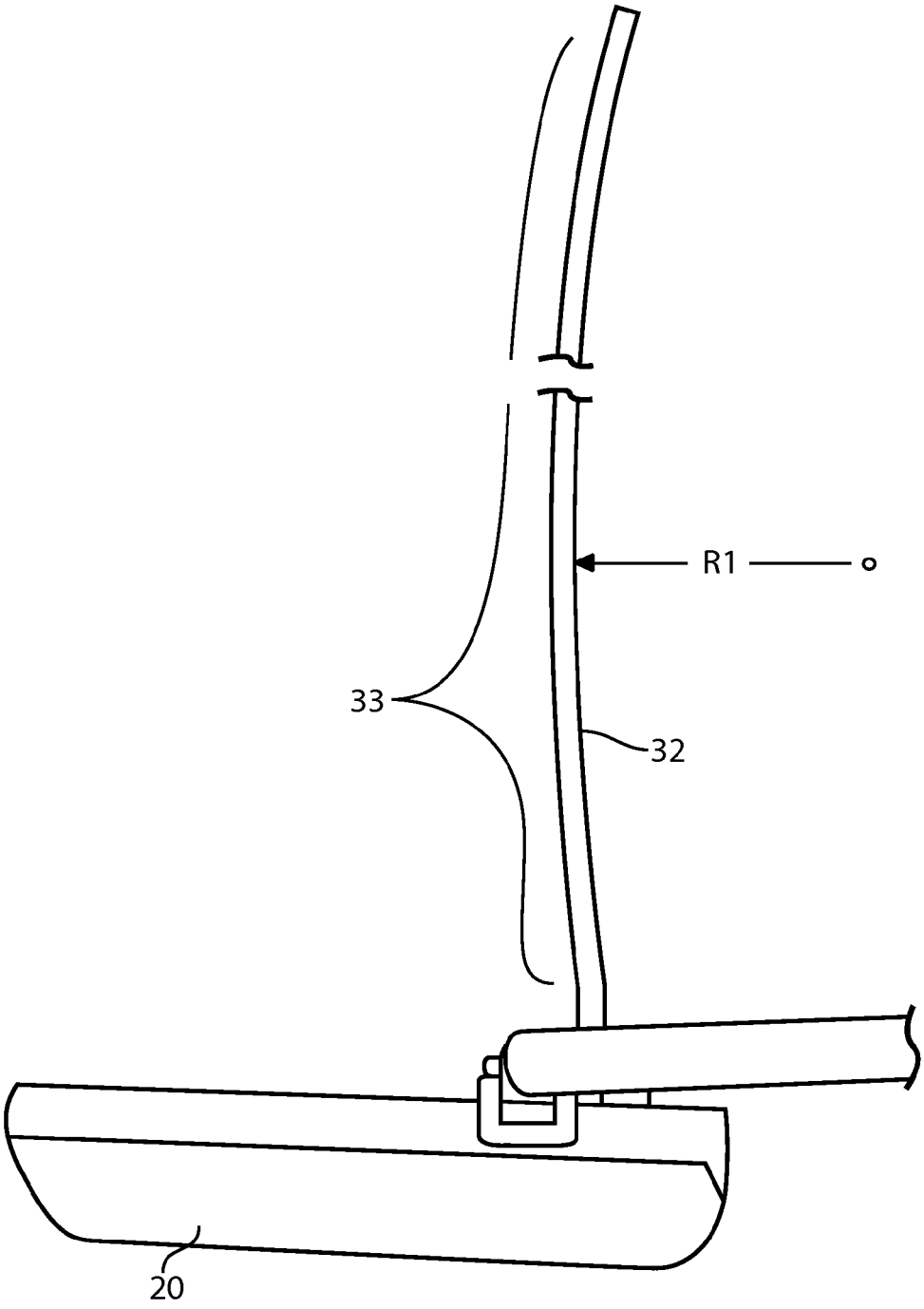
FIG. 3. is a top view of a putter head connected to a training rod presenting a curved shape.

The training rod 32 is preferably between six inches long and three feet long. The training rod 32 has an opposing first end and second end. However, the training rod 32 is not linear between its first end and second end. Rather, the training rod 32 contains at least one curved section 33 (FIG. 3). The curved section 33 can extend the entire length of the training rod 32, or can extend only across a portion of the training rod 32.

The training rod 32 is preferably tubular, so as to be as lightweight as possible. Although the training rod 32 can be a metal tube, such as aluminum, the training rod 32 can also be a synthetic material, such as plastic or a carbon composite, to make the training rod 32 more resistant to accidental bending. Alternatively, the training rod 32 can be made of a coiled spring so as to be highly flexible and nearly impervious to bending damage.

Referring to FIG. 3, a training rod 32 is shown that has a first radius of curvature R1. If the training rod 32 is attached to the putter head 20, the full radius of curvature lay in a horizontal plane. The golfer looking down at the training rod will see the full curvature of the training rod 32.

Figure 4:
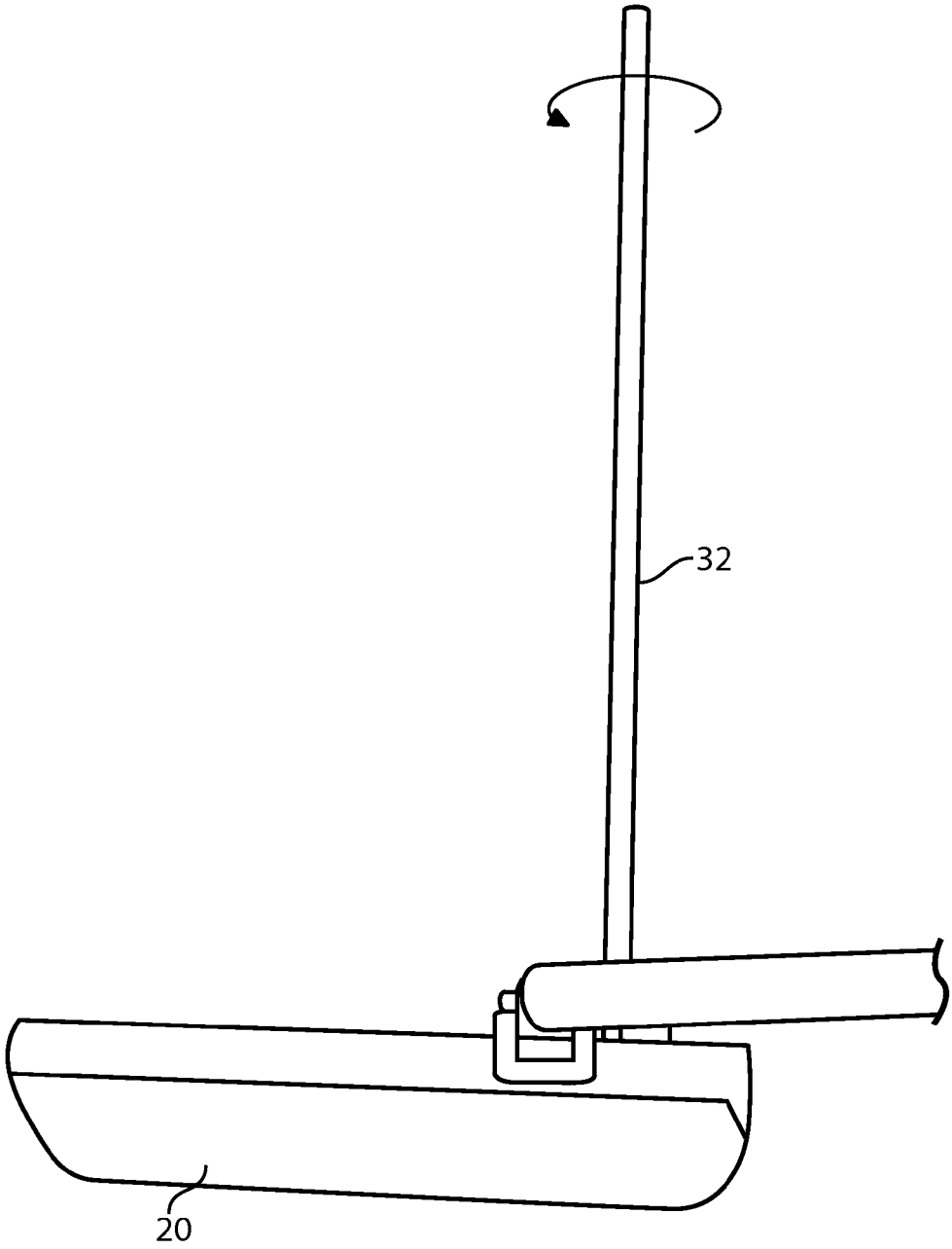
FIG. 4 is a top view of a putter head connected to a training rod presenting a straight shape.

However, as is shown by FIG. 4, if the training rod 32 is rotated 90 degrees so that the radius of curvature lay in a vertical plane, then a golfer looking down at the training rod 32 will see no curvature. Rather, the training rod 32 will appear to be straight.

Returning to FIG. 2, it will be understood that the degree of curvature in the training rod 32 that is perceived by a golfer is dependent upon the rotational position of the training rod 32 as it is attached to the putting head 20. Consequently, although the training rod 32 is static, it can present a large number of different curvatures to the golfer.

In the shown embodiment, the putting guide assembly 30 that supports the training rod 32 is attached to the vertical leg 26 of the putter 10. This supports the training rod 32 in front of the striking face 22 of the putter 10. However, it will be understood that the training rod 32 can pass along the top of the putter head 20 or even attach to the shaft 12 of the putter 10. The point of attachment is not of great importance. Rather, what is of importance is that the training rod 32 extends forward of the putter head 20 and that the training rod 32 can be selectively rotated and viewed from above when putting.

To use the putter 10, a golfer selects a training rod 32 having a length at least as long as the putting swing the golfer wants to practice. The golfer then sets the selected training rod 32 into the rod anchor block 36 of the putting guide assembly 30. The putting guide assembly 30 is attached to the putter head 20 and the training rod 32 is adjusted so that the curvature of the training rod 32 that is observed by the golfer matches the natural curvature of the golfer's putting stroke. The perceived curvature of the training rod 32 can be selectively changed by rotating the training rod 32 to different orientations. The golfer also adjusts the anchor block 36 to selectively move the training rod 32 in either the direction of arrow 43 or arrow 45. In this manner, the training rod 32 can be made to compliment the natural swing of the golfer so that the training rod 32 itself remains constant during a swing.

Optionally, the training rod 32 can be color coated in various sections along its length. Different colors are used along the length of the training rod 32. Depending on the golfer's swing and how far of a putt is to be made, a golfer can use the colored sections 27 to gauge the swing of the putter 10.

Figure 5:
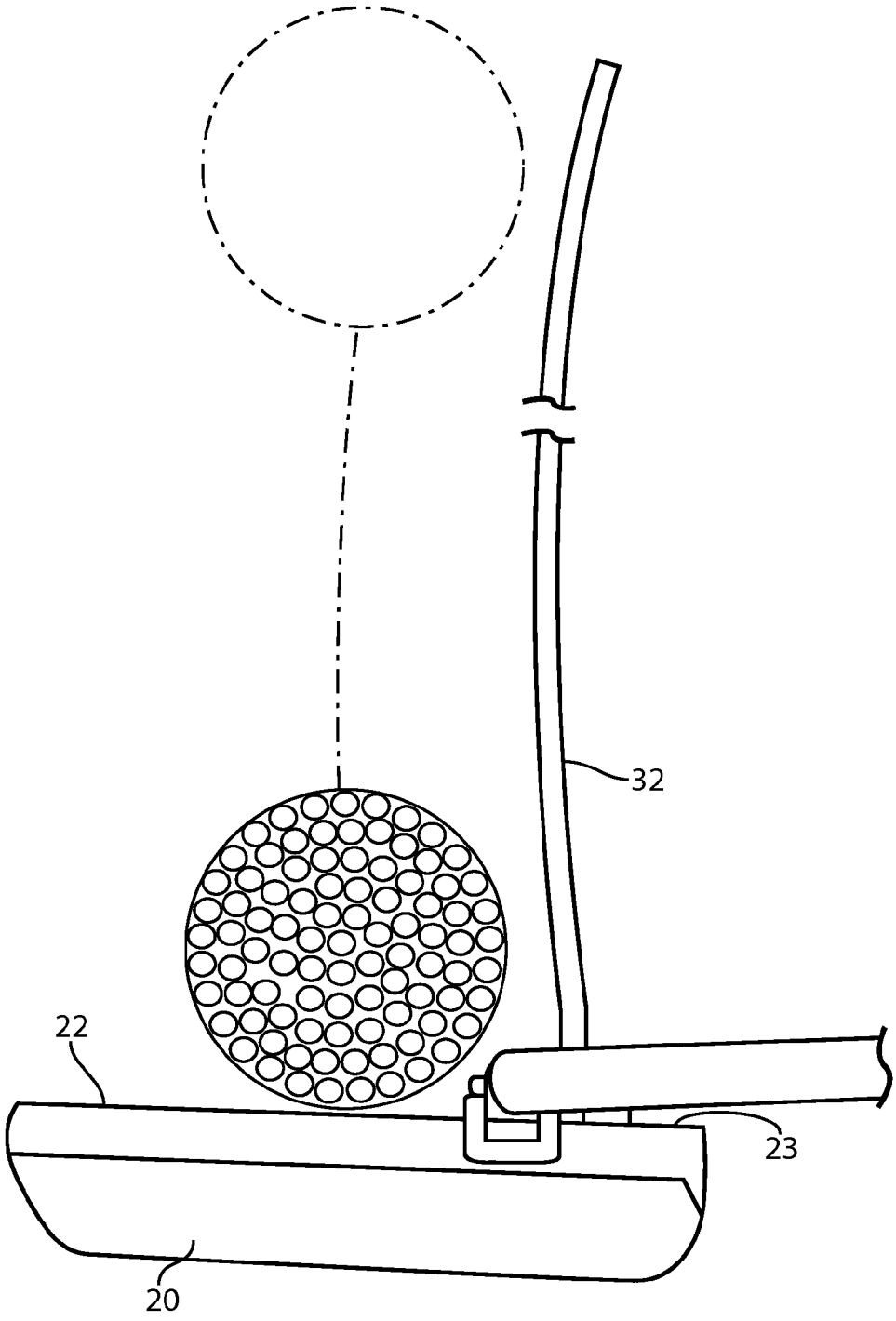
FIG. 5 is a perspective view of a putter head with the training rod engaging a golf ball.

Referring to FIG. 5, it can be seen that when the training rod 32 is attached to the putter head 20, the training rod 32 extends forward of the striking surface 22 of the putting head 20. The training rod 32 is supported a predetermined height above the ground. The positional height of the training rod 32 is calculated so that during a golf swing the training rod 32 will be positioned adjacent the center of a golf ball.

The training rod 32 extends from the striking surface 22 of the putter head 20 in the heel section 24 of the putter head 20. The training rod 32 is positioned so that the training rod 32 will just contact the side of a golf ball when the golf ball strikes the exact center of the striking surface 22. If a golfer putts correctly, the training rod skims along the side of a golf ball at a tangent. The training rod 32 acts as both a physical and optical guide that helps a golfer swing a putter and contact a golf ball with the exact center of the putter. A golfer may have a slight curve in his/her swing. The training rod 32 is adjusted in position so that it matches this natural curvature.

It a golfer twists the putter during a putt, the training rod 32 will either move away from the golf ball or push the golf ball off line. It will therefore be understood that the training rod 32 will only touch the tangent edge of the golf ball, if a golfer is using a correct swing.

With most golfers, the error that occurs in their putting swing is that the golf ball travels toward the heel section 24 of the putter head 20 during the swing. It is for this reason that the shown embodiment has the training rod 32 in the heel section 24 of the putter head 20. However, if a golfer has the opposite problem, a golfer can use the embodiment of the present invention putter 10 where the training rod 32 extends from the toe section 23 of the putter head 20.

In either embodiment, it is preferred that only one training rod 32 extends from the striking surface 22 of the putter head 20. If two training rods were used, a golfer would have to approach the golf ball in an unusual manner and lower the golf club over the golf ball so that the training rods do not touch the golf ball. This would cause the approach to the golf ball during training to be different from the approach of the golf ball during regulation play. By using only a single training rod 32, a golfer can move the putter 10 laterally next to the golf ball and therefore approach a golf ball in the same manner they would if the training rod 32 were not present. This creates consistency between training to putt and actually putting during a game.

The present invention putter enables a golfer to attach a training rod 32 to the striking surface 22 of the putter 10 when the golfer is practicing golf. The training rod 32 provides both a tactile and visual guide that helps a golfer create and perfect a straight putting swing. The use of a single training rod 32 also enables a golfer to approach a golf ball and position the putter adjacent the golf ball in the traditional manner. Thus, the approach to the golf ball during practice can be kept consistent with the approach to the golf ball during regulation play.

Figure 6:
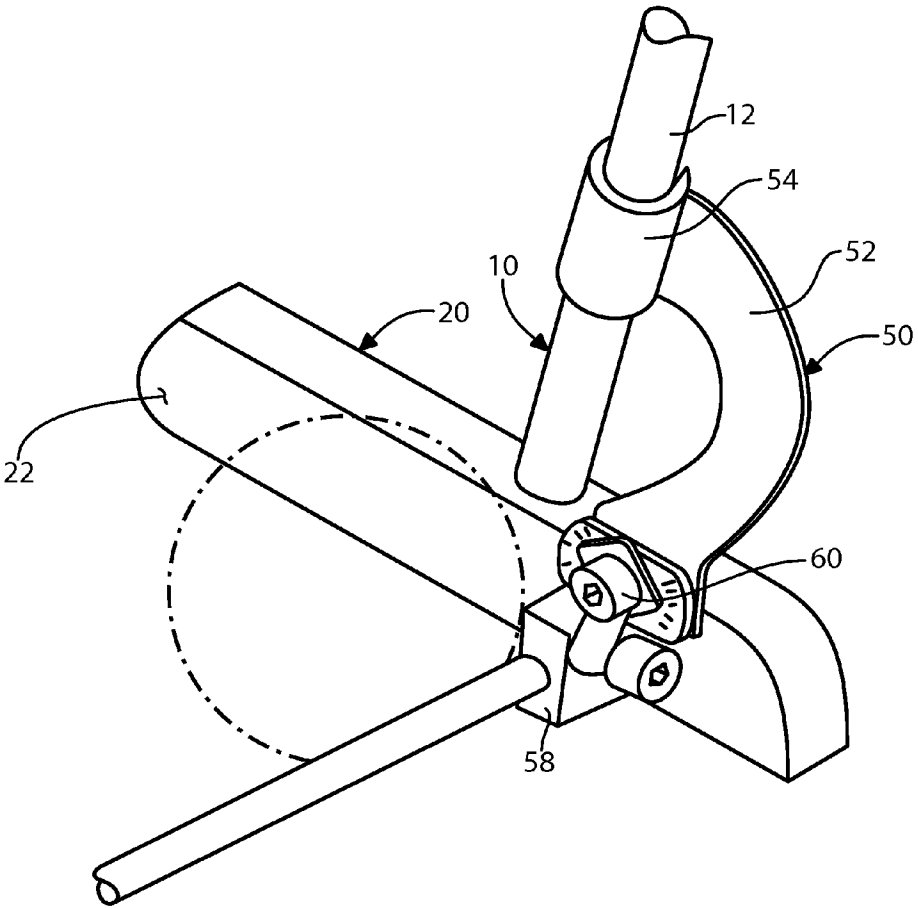
FIG. 6 is a perspective view of an alternate embodiment of the present invention with the training rod engaging a golf ball.

There are many types of putters. Not all putters have vertical necks. Accordingly, a putting guide assembly that attaches to the vertical neck of a putter cannot always be used. Referring to FIG. 6, an alternate embodiment of a putting guide assembly 50 is shown. In this embodiment a bracket 52 is provided. The bracket 52 has a collar 54 at its top end that engages the shaft 12 of a putter 10. The collar 54 can be locked to the shaft 12 using set screws.

The bottom of the bracket 52 is attached to a rod anchor block 58 with a first pivot screw 60 and a second pivot screw 61. The presence of the first and second pivot screw 60, 61 enables the rod anchor block 58 to be adjusted in position relative the bracket 52 and the shaft 12. The rod anchor block 58 supports a training rod 62 in front of the striking surface 22 of the putter 10. By adjusting the first and second pivot screw 60, 61, the training rod 62 can be rotated so that its perceived curvature matches the need of the user.

It will be understood that the embodiments of the putting guide assembly that has been described and illustrated are merely exemplary and that a person skilled in the art can make many variations to those embodiments. For example, the shape of the putter head can be varied to match most any known design. The method of attaching the training rod to the putter head can be varied from the configurations shown. All such variations, modifications and alternate embodiments are intended to be covered by the scope of the present invention as defined by the claims.

What is claimed is:

1. A training guide assembly for a golf putter of the type having a shaft, a putter head, and a neck between the putter head and the shaft, wherein said putter head has a toe section, a heel section and a central section, said training guide assembly, comprising:

a mechanical clamp sized and dimensioned to engage the golf putter proximate the putter head;

an anchor element coupled to said mechanical clamp at a pivot connection, wherein said anchor element is selectively rotatable about said pivot connection in a vertical plane, and a rod having a first end, a second end, and at least one curved section between said first end and said second end, wherein said first end of said rod is received by said anchor element and said rod extends away from said anchor element.

2. The assembly according to claim 1, wherein said mechanical clamp is sized to receive and engage said neck.

3. The assembly according to claim 1, wherein said mechanical clamp is sized to receive and engage said shaft of said putter.

4. The assembly according to claim 1, wherein said first end of said rod is selectively relatable within said anchor element, said assembly further including a locking mechanism for locking said rod into a selected rotated position relative said anchor element.

5. The assembly according to claim 1, wherein said rod has a length of between six inches and three feet.

6. The assembly according to claim 1, wherein said assembly holds said rod so that said rod extends forward of said heel section.

7. The assembly according to claim 1, further including a gauge for visualizing a rotational position about said pivot connection between said anchor element and said mechanical clamp.

8. A method of altering a configuration of a golf putter for use in training, said method comprising the steps of:

providing a putter having a striking face for striking a golf ball;

providing a rod, wherein said rod has at least one curved section that presents a predetermined curvature in a horizontal plane;

attaching said rod to said putter so that said rod extends forward of said striking face; and selectively rotating said rod relative said putter to selectively alter said predetermined curvature presented in the horizontal plane.

9. The method according to claim 8, wherein said step of attaching said rod to said putter includes suspending an anchor element in front of said striking face of said putter, and attaching one end of said rod to said anchor element.

10. The method according to claim 9, wherein said step of suspending an anchor element in front of said striking face of said putter includes attaching said anchor element to a mounting clamp and attaching said mounting clamp to said putter.

11. The method according to claim 8, wherein said rod has a length of between six inches and three feet.

12. A putter head assembly, comprising:

a striking surface for striking a golf ball, said striking surface having a toe region, a heel region and a center region disposed between said toe region and said heel region;

an anchor element disposed in front of said striking surface, wherein said anchor element is rotatable in a vertical plane about a pivot connection;

a rod having a first end and a second end, wherein said rod has at least one curved section disposed between said first end and said second end, wherein said rod is received within said anchor element, thereby causing said rod to protrude forward from said striking surface.

13. The assembly according to claim 12, further including a locking mechanism for locking said rod into a selected rotated position.

14. The assembly according to claim 12, wherein said anchor element is affixed to a mounting device that can be selectively attached and detached from said putter head assembly.

15. The assembly according to claim 12, wherein said anchor element is disposed in said heel region of said striking surface.

16. The assembly according to claim 12, wherein said anchor element is disposed in said toe region of said striking surface.

* * * * *